US007896265B2

(12) United States Patent
Takahashi et al.

(10) Patent No.: US 7,896,265 B2
(45) Date of Patent: Mar. 1, 2011

(54) COATING APPARATUS

(75) Inventors: Hiroaki Takahashi, Tochigi (JP); Masaaki Shoji, Tochigi (JP); Masashi Honma, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 205 days.

(21) Appl. No.: 12/212,298

(22) Filed: Sep. 17, 2008

(65) Prior Publication Data

US 2009/0078801 A1 Mar. 26, 2009

(30) Foreign Application Priority Data

Sep. 20, 2007 (JP) ..... 2007-244497
Sep. 20, 2007 (JP) ..... 2007-244499
Sep. 20, 2007 (JP) ..... 2007-244500

(51) Int. Cl.
*B05B 5/00* (2006.01)

(52) U.S. Cl. ..... 239/703; 239/224; 239/296; 239/690; 239/700; 239/704

(58) Field of Classification Search ..... 239/214.11, 239/223, 224, 290, 296, 298, 600, 690, 699, 239/700, 703, 704
See application file for complete search history.

(56) References Cited

U.S. PATENT DOCUMENTS

| | | | | |
|---|---|---|---|---|
| 4,572,437 | A | 2/1986 | Huber et al. | |
| 5,358,182 | A * | 10/1994 | Cappeau et al. | 239/703 |
| 5,704,977 | A * | 1/1998 | Baumann et al. | 239/223 |
| 5,862,988 | A * | 1/1999 | van der Steur | 239/703 |
| 6,050,499 | A * | 4/2000 | Takayama et al. | 239/296 |
| 6,889,921 | B2 * | 5/2005 | Schaupp | 239/700 |

FOREIGN PATENT DOCUMENTS

| | | | |
|---|---|---|---|
| JP | 58-193752 | A | 11/1983 |
| JP | 10-071345 | A | 3/1998 |
| JP | 2006-167518 | A | 6/2006 |

* cited by examiner

*Primary Examiner* — Steven J Ganey
(74) *Attorney, Agent, or Firm* — Arent Fox LLP

(57) ABSTRACT

The coating apparatus comprises a body part, a head part detachably installed to this body part, and a connecting ring connecting the body part with the head part. The body part is provided with a cascade that boosts and outputs electric power and a plurality of tubes and a passage in which at least one of the optical signal, air, and coating circulates. The head part is provided with the rotary atomization head, an electric power transmission line that transmits the electric power output from the cascade, and a passage. On the connecting face of the body part, at least part of the cascade projects, and third port of the passage is exposed. On the connecting face of the head part, the electric power transmission line is connected, and a cascade insertion part in which the projected part of the cascade is inserted is formed, and a fourth port connected to the third port.

4 Claims, 14 Drawing Sheets

COATING APPARATUS

This application is based on and claims the benefit of priority from Japanese Patent Application Nos. 2007-244497, 2007-244499, and 2007-244500, filed on 20 Sep. 2007, the content of which is incorporated herein by reference.

BACKGROUND OF THE INVENTION

1. Field of the Invention

The present invention relates to a coating apparatus. Specifically, it relates to a rotary atomization coating apparatus that conducts electrostatic coating by spraying liquid coating from the top of a rotary atomization head to.

2. Related Art

Conventionally, the rotary atomization coating apparatus is known as, for example, a coating apparatus for coating the body of a vehicle. This rotary atomization coating apparatus supplies electrically-conductive coating (liquid coating) to the rotary atomization head as it rotates the rotary atomization head, applying a high voltage thereto. This leads a liquid coating to be charged, atomized, and then sprayed from the top of the rotary atomization head and thereby conducting electrostatic coating.

For example, the above-mentioned coating apparatus is installed at the top of a robot arm and provided with a rotary atomization head, a drive mechanism for rotating this rotary atomization head, and a housing for accommodating these components. Problems to be solved by the invention However, in the structure disclosed in Unexamined Japanese Patent Application, First Publication No. 2006-167518, the coating apparatus is entirely integrates. Accordingly, it is necessary to detach the entire coating apparatus from the robot arm when the coating apparatus is repaired or adjusted. Therefore, it occasionally takes time to repair and adjust the coating apparatus.

In addition, a channel is provided in the housing in such a structure. This causes a problem that the inside of the channel is hardly checked. Moreover, the channel is formed in the housing. This causes a problem that the outer diameter and thereby increasing the weight of the entire coating apparatus.

Moreover, in the structure disclosed in Unexamined Japanese Patent Application, First Publication No. H10-71345, the top face of the coating apparatus is approximately flat, and two air nozzles are formed thereon. These two air nozzles formed on the approximately-flat top face causes a problem that the direction to which air is ejected from the external air nozzle is unstable whereby the coating pattern is hardly set.

Furthermore, in the structure of Unexamined Japanese Patent Application, First Publication No. S58-193752, the external air nozzle is located at the rear side of the internal air nozzle to the coating spray direction, and a step is formed between these two air nozzles. Therefore, the step generates whirlpools in the flow of air ejected from the external air nozzle, whereby back whirlpools occurs to possibly cause a contaminated coating nozzle.

A first object of the present invention is to provide a coating apparatus that can facilitate repair and adjustment thereof. In addition, a second object of the present invention is to provide a coating apparatus that can easily check air and coating channels and be reduced in weight. Moreover, a third object of the present invention is to provide a coating apparatus that can easily set a coating pattern and prevent contamination of a coating nozzle.

SUMMARY OF THE INVENTION

The coating apparatus of the present invention (for example, coating apparatus 1) conducts electrostatic coating by supplying liquid coating to the rotary atomization head as this rotary atomization coating apparatus rotates the rotary atomization head, applying a high voltage thereto and thereby charging and atomizing liquid coating and then spraying it from the rotary atomization head (rotary atomization head 21). The carting apparatus comprises a body part (for example, body part 10); a head part (for example, head part 20) detachably installed to the body part; and a connection part (for example, connection ring 50) for connecting the body part with the head part, wherein the body part is provide with a cascade (for example, cascade 41) that boosts and outputs electric power and a plurality of first channels (for example, tubes 13 and passage 435) in which at least one of an optical signal representing the revolutions of the rotary atomization head, air, and coating circulates, the head part is provided with the rotary atomization head, an electric power transmission line (for example, electric power transmission line 26) that transmits electric power output from the cascade, and a second channel (for example, passage 202). On the connecting face of the body part, at least part of the cascade projects, and an end face of the first channel (for example, third port 433) is exposed. On the connecting face of the head part, the electric power transmission line is connected, and an insertion part (for example, cascade insertion part 24) in which the projected part of the cascade is inserted is formed, and an end face of the second channel (for example, fourth port 201) connected to the end face of the first channel is exposed.

According to this invention, the body part and the head part approach each other to fix by connection part. Then, while the projected part of the cascade is inserted in the insertion part to connect the cascade with the electric power transmission line, the end face of one of the first channels is connected to the end face of the second channel. Since the coating apparatus is thus divided into the body part and the head part, the coating apparatus can be easily repaired and adjusted. Even if the coating apparatus is installed on a robot arm, it is not necessary to detach the entire coating apparatus from the robot arm, so that it is possible to detach only the head part, when the coating apparatus is repaired and adjusted. Thus, the electric power output from cascade can be transmitted through the electric power transmission line. In addition, while an optical signal, air, and coating circulating in the first channels circulates to the second channel, those circulating in the second channel to the first channel can be circulated. Since the coating apparatus is thus divided into the body part and the head part, the coating apparatus can be easily repaired and adjusted. Even if the coating apparatus is installed on a robot arm, it is not necessary to detach the entire coating apparatus from the robot arm, so that it is possible to detach only the head part, when the coating apparatus is repaired and adjusted.

The coating apparatus of the present invention (for example, coating apparatus 1) conducts electrostatic coating by supplying liquid coating to the rotary atomization head as this rotary atomization coating apparatus rotates the rotary atomization head, applying a high voltage thereto and thereby charging and atomizing liquid coating and then spraying it from the rotary atomization head (rotary atomization head 21). The coating apparatus comprises a main body (for example, head part 20 and body part 10); a rotary atomization head (for example, rotary atomization head 21) installed on the top side of the main body; a plurality of channels (for example, tubes 13 and passages 435 and 202) extending from the bottom side to the top side of the main body, in the plurality of channels, air and coating circulating, wherein wherein the outer diameter of the central part of the main body is smaller than that of the both end sides thereof, at least parts of the plurality of channels are transparent tubes (for example, tubes 13), and the tubes are arranged on the outer peripheral face along the central part of the main body.

According to the present invention, since the outer diameter of the central part of the main body is smaller than that of the both end sides thereof, the coating apparatus can be lightened. In addition, at least parts of the plurality of channels are transparent tubes, and these tubes are arranged on the outer peripheral face along the central part of the main body. Thus, air and coating channels can be easily checked by visually checking the situation in these tubes and installing the measuring instrument to these tubes. For example, in the case in which a problem occurs when the coating color of a vehicle is changed, the flow condition of coating can be easily checked by visually checking the tube in which this coating circulates. Moreover, in the case in which a problem regarding coating range control occurs, the flow condition of air can be easily checked by exchanging the tube in which air circulates for the tube to which a measuring instrument is installed.

In this case, it is preferable to further provide a cover part (for example, cover part 12) that covers the central part of the main body.

According to the present invention, the cover part that covers the central part of the main body is provided, whereby contamination of the translucent tube can be prevented while the coating apparatus is driven. On the other hand, when the coating apparatus is checked, the translucent tube can be easily checked by detaching only the cover part.

The coating apparatus of the present invention (for example, coating apparatus 1) conducts electrostatic coating by supplying liquid coating to the rotary atomization head as this rotary atomization coating apparatus rotates the rotary atomization head, applying a high voltage thereto and thereby charging and atomizing liquid coating and then spraying it from the rotary atomization head (rotary atomization head 21). The coating apparatus comprises a first circular air nozzle (for example, a first air nozzle 74) formed, surrounding the rotary atomization head; a second circular air nozzle (for example, second air nozzle 75) formed, surrounding the first air nozzle and located at the rear side from the first air nozzle to the coating spray direction; and a slope (for example, slope 76) stretching from the second air nozzle to the first air nozzle.

According to the present invention, the first circular air nozzle is provided, surrounding the rotary atomization head, and the second air nozzle is further provided, surrounding the first air nozzle. In addition, the slope is provided, extending from the second air nozzle to the first air nozzle. Thus, air is ejected forward from the second air nozzle along the slope to generate an air curtain, so that an air ejection direction can be stable, whereby the coating pattern can be easily set. In addition, whirlpools can be prevented from generating in the flow of air, and thereby causing no returning whirlpools of coating, so that the contaminated nozzle part can be prevented.

According to this invention, the body part and the head part approach each other to fix by connection part. Then, while the projected part of the cascade is inserted in the insertion part to connect the cascade with the electric power transmission line, the end face of one of the first channels is connected to the end face of the second channel. Thus, the electric power output from cascade can be transmitted through the electric power transmission line. In addition, while an optical signal, air, and coating circulating in the first channels circulates to the second channel, those circulating in the second channel to the first channel can be circulated. Since the coating apparatus is thus divided into the body part and the head part, the coating apparatus can be easily repaired and adjusted. Even if the coating apparatus is installed on a robot arm, it is not necessary to detach the entire coating apparatus from the robot arm, so that it is possible to detach only the head part.

DETAILED DESCRIPTION OF THE INVENTION

Each embodiment of the present invention is described in more detail with reference to the accompanying drawings.

First Embodiment

Figure 1:
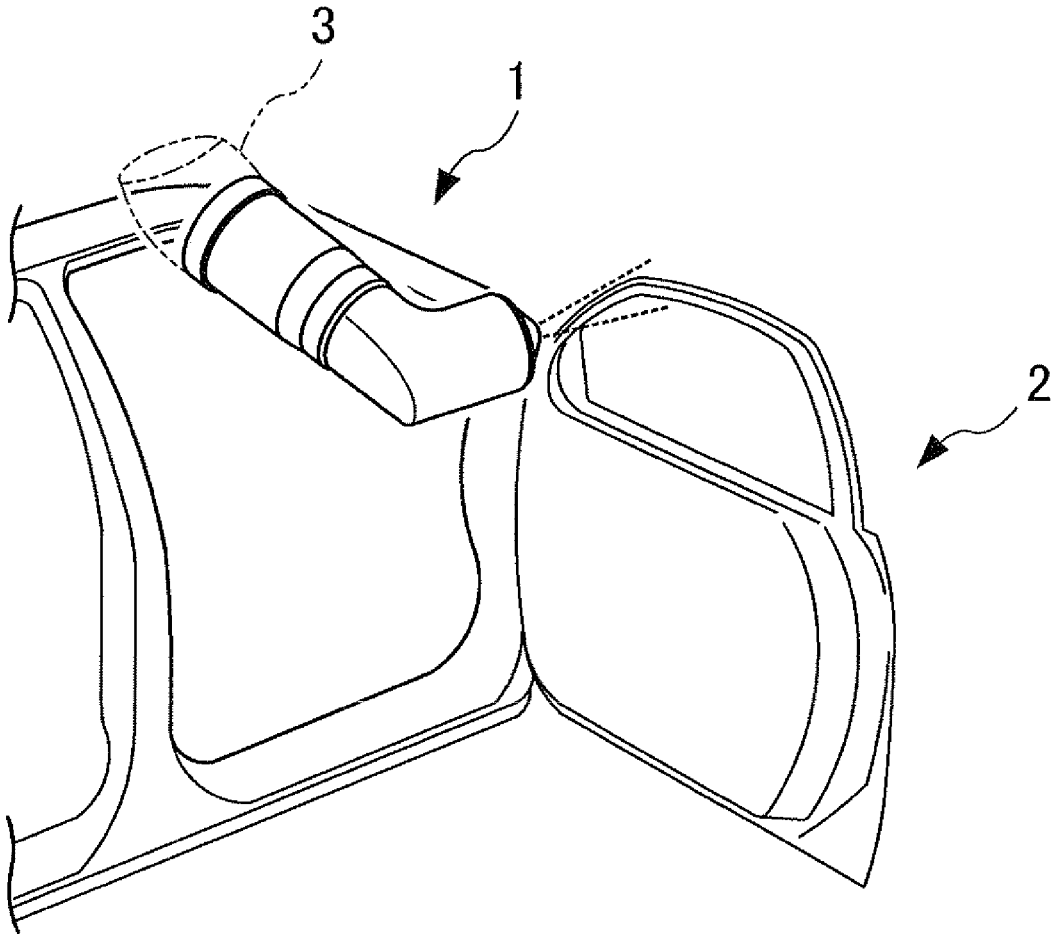
FIG. 1 is a perspective view that shows operation of the coating apparatus according to a first embodiment of the present invention.
Figure 2:
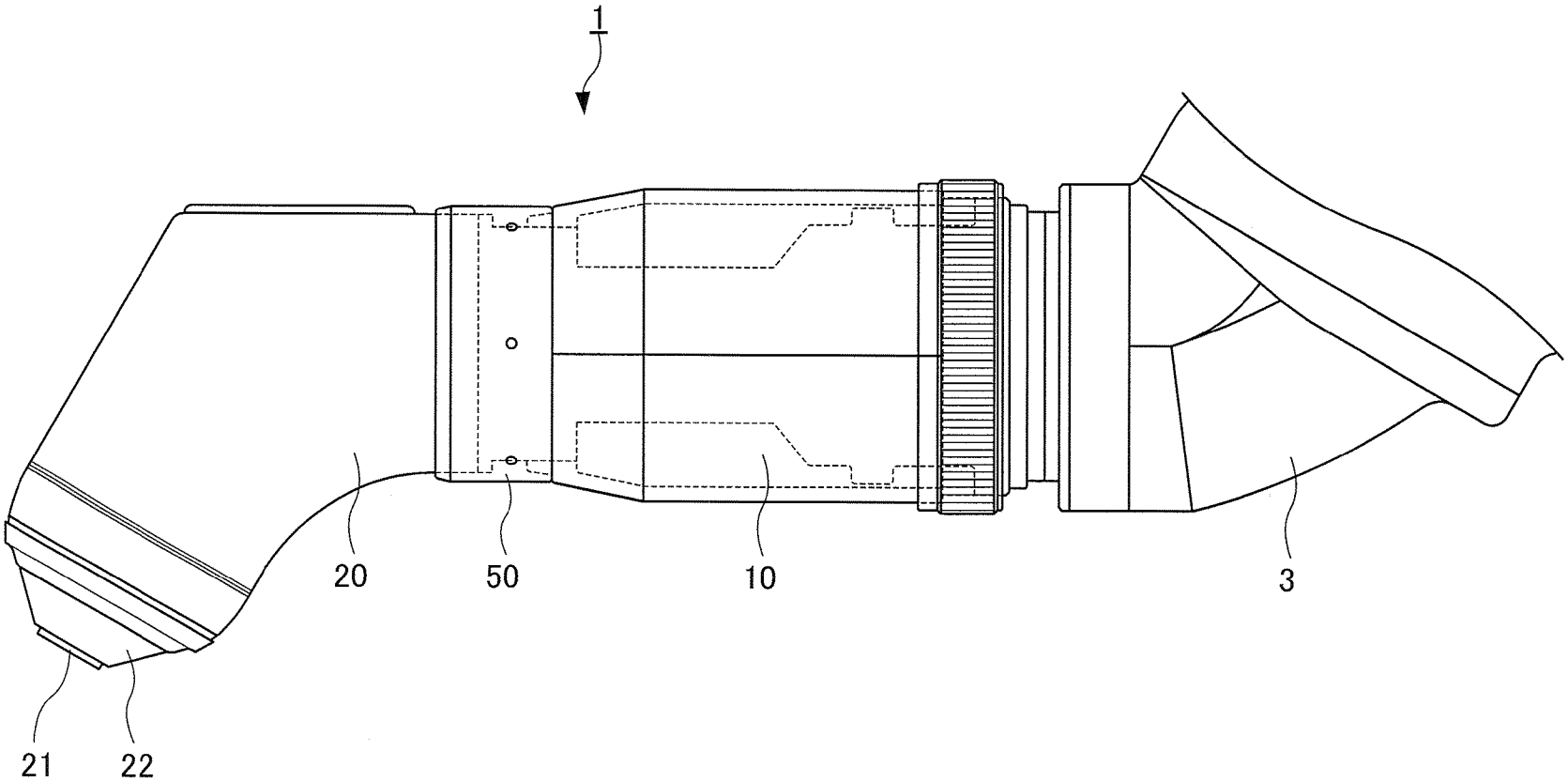
FIG. 2 is a side view of the coating apparatus according to the first embodiment of the present invention.

FIG. 1 is a perspective view that shows operation of the coating apparatus 1 according to a first embodiment of the present invention. FIG. 2 is a side view of the coating apparatus 1. The coating apparatus 1 conducts electrostatic coating for a vehicle's body 2, and comprises a columnar body 10 installed on the top of a robot arm 3, a head part 20 detachably installed on the top of this body part 10, and a connection ring 50 as a connection part that connects the body part 10 with the head part 20.

Figure 3:
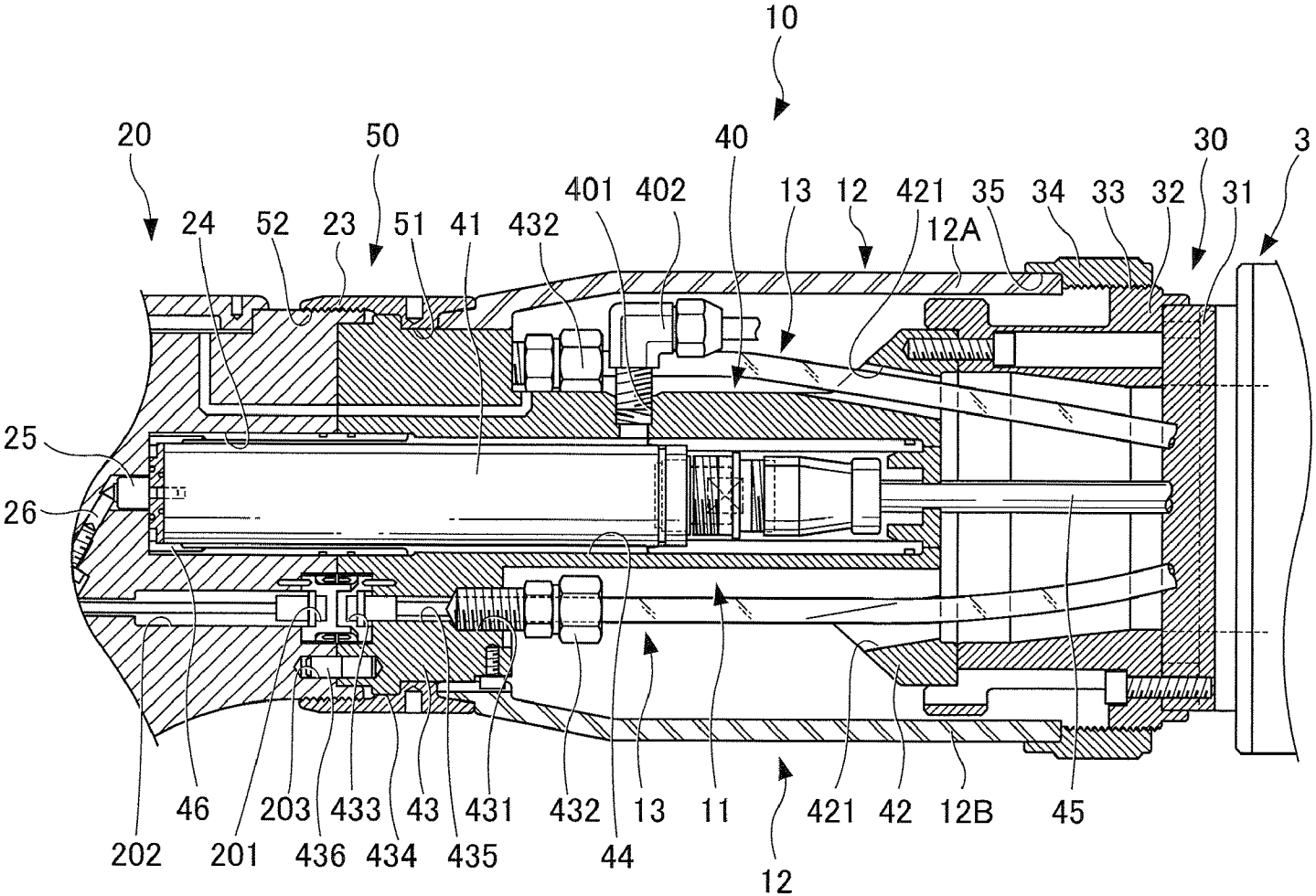
FIG. 3 is a part enlarged section view of the coating apparatus according to the first embodiment of the present invention.

FIG. 3 is a part enlarged section view of the coating apparatus 1. The body part 10 is provided with a long main part 11 of the body part to which the tubes 13 as the plurality of first channels are connected, and a cover part 12 that covers the outer peripheral face of the central part of this main part 11 of the body part.

The main part 11 of the body part is provided with a base part 30, a cascade accommodation part 40 installed in this base part 30 and accommodating the cascade 41.

The base part 30 is provided with a discoid bottom part 31, and a wall part 32 arranged on the outer periphery of this bottom part 31. A threaded part 33 is provided on the outer peripheral face of the wall part 32, and a cylindrical holder 34 is threadably mounted on this threaded part 33. A concave part 35 is formed over the periphery thereof inside the top side of this holder 34.

The cascade accommodation part 40 is in long shape, and a bottom flange part 42 and a top flange part 43, in the shape of guard, are formed on the bottom side and the top side thereof.

A through-hole 44 is formed, being extended from the bottom side to the top face of the cascade accommodation part 40, and accommodates the cascade 41. Specifically, the cascade 41 is accommodated, so that a space exists between most of the outer peripheral face of cascade 41 and the inner peripheral wall face of the through-hole 44.

The cascade 41 is connected to a low voltage cable 45 passing through the base part 30 and then extends, and electric power supplied through this low voltage cable 45 is boosted and then output. The top side of this cascade 41 axially projects from the approximate center of the top face of the top flange part 43, and a cascade cover 46 is installed on the top of this cascade 41.

A first port 401 is provided on the outer peripheral face of the cascade accommodation part 40, and connected to the above-mentioned tubes 13 through the joints 402.

The bottom flange part 42 is fixed to the base part 30, sealing the open face of the base part 30. A plurality of tube insertion holes 421 through which the above-mentioned tubes 13 are inserted are formed in this bottom flange part 42.

A plurality of second ports 431 are provided, being circularly arranged on the bottom face of top flange part 43. These second ports 431 are connected to the above-mentioned tubes 13 through the joints 432 respectively. In addition, a protrusion 434 is formed on the outer peripheral face of the top flange part 43 over the periphery thereof.

Figure 4:
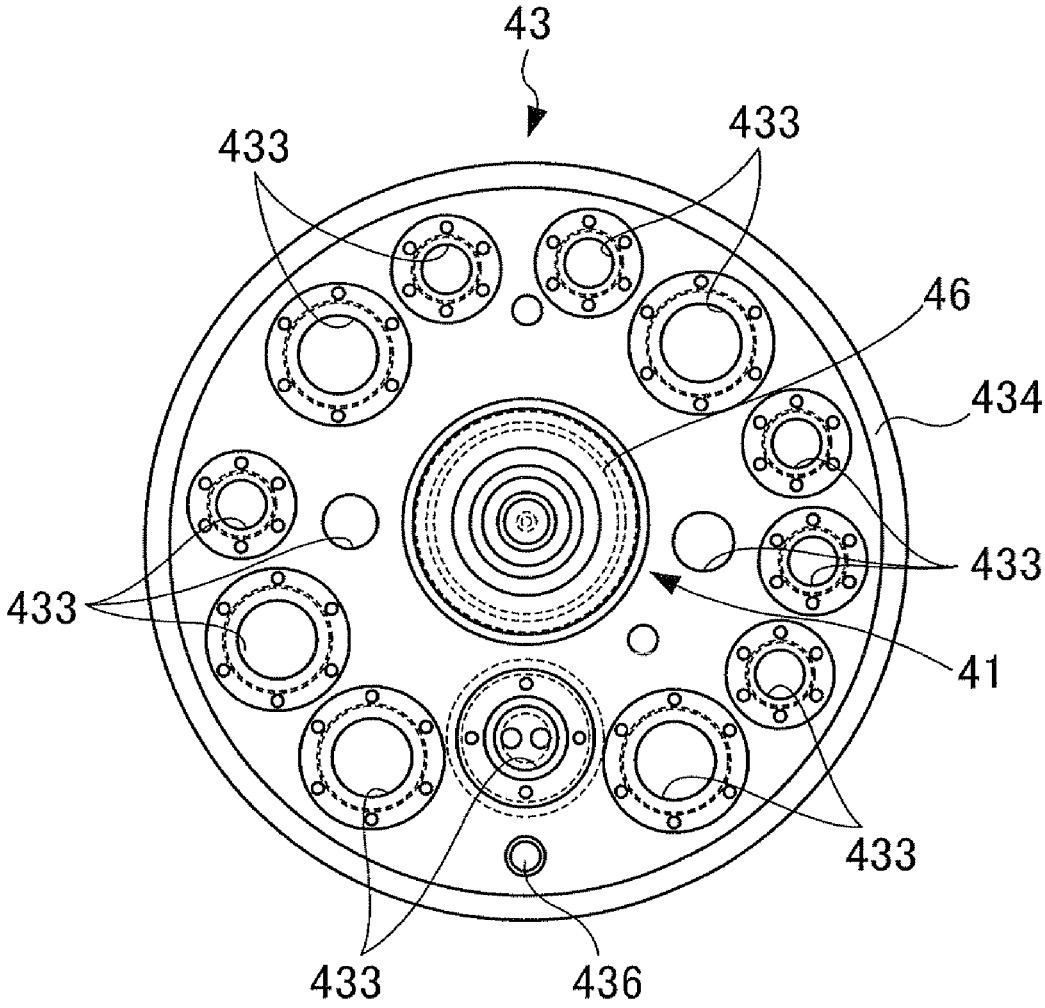
FIG. 4 is a front view of the top flange part of the coating apparatus according to the first embodiment of the present invention.

FIG. 4 is a front view of the top flange part 43. The third ports 433 as the end face of one of the first channels are provided on the top face of top flange part 43, being circularly arranged. These third ports 433 are provided, being evenly exposed to the top face of top flange part 43, and communicated with the second ports 431 and the first port 401 respectively through the passage 435 as one of the first channels. The second port 431 shown in FIG. 3 is communicated with the through-hole 44 that accommodates the cascade 41, and other second ports (not shown) are communicated with the third ports 433. In addition, a locating pin 436 is provided, projecting on the outer side of the top face of the top flange part 43.

Returning to FIG. 3, the connection ring 50 is in a cylindrical shape, and a protrusion 51 is formed over the inner peripheral face along the bottom side of the connection ring 50. In addition, a threaded part 52 is formed on the inner peripheral face along the top side of the connection ring 50. The protrusion 51 of the connection ring 50 is latched to the protrusion 434 of the top flange part 43, whereby the connection ring 50 is restricted to move to a top side, but it is allowed to be rotatable.

A plurality of tubes 13 are transparent and pass through the flange face of the robot arm 3 from a light supply source (not shown), a compressed air supply source (not shown), and a coating supply source (not shown), and then extend to the inside of the base part 30. In addition, these tubes 13 are inserted through to tube insertion holes 421 in the cascade accommodation part 40, extends along the outer peripheral face in the cascade accommodation part 40, and are then connected to the second ports 431 and the first port 401.

An optical signal supplied from the light supply source, air supplied from the compressed air supply source, and liquid coating supplied from the coating supply source circulate in these tubes 13 and reach the second ports 431 and then the fourth ports 201 through the passage 435. In addition, the tube 13 extending from the light supply source accommodates an optical fiber, and an optical signal is transmitted through this optical fiber.

The cover part 12 is in a cylindrical shape and is allowed to be divided into two parts along the main part 11 of the body part. Specifically, the cover part 12 is consisting of two half-cylindrical cover pieces 12A and 12B. The top edges of the cover pieces 12A and 12B are inserted between the inner peripheral face of the connection ring 50 and the outer peripheral face of the top flange part 43 in the main part 11 of the body part. Moreover, the bottom edge of the cover pieces 12A and 12B engages with a concave part 35 on the top side of the holder 34 of the main part 11 of the body part.

The head part 20 is in an approximate dog-leg shape, in which the top end thereof bends, and is provided with an air motor (not shown), the rotary atomization head 21 rotationally driven by this air motor, a coating supply part (not shown) that supplies coating the rotary atomization head 21, and an air cap 22 surrounding the rotary atomization head 21 (See FIG. 2). The threaded part 23 is formed on the outer peripheral face along the bottom side of the head part 20, and the threaded part 52 of the connection ring 50 is threadably mounted on the threaded part 23 of this head part 20.

On the bottom face of the head part 20, the fourth ports 201 as the end face of the second channel are arranged respectively at the position corresponding to the third ports 433 provided in the top flange part 43 in the body part 10. These fourth ports 201 are provided, being evenly exposed to the bottom base of the head part 43, and communicated with the above-mentioned coating supply part, the air motor, the rotation atomization head, and the air cap 22 through the passage 202 as the second channel.

Accordingly, an optical signal, air, and liquid coating that have reached to the fourth ports 201 circulate in this passage 202, and be then supplied to the coating supply part, the air motor, the rotary atomization head 21, and the air cap 22. In addition, an optical signal, air, and liquid coating output from the coating supply part, the air motor, the rotary atomization head 21 and then circulating in the passage 202 reaches the fourth ports 201 and then circulate to the passage 435 and the tubes 13.

In addition, a plurality of O rings 204 surrounding the fourth ports 201 respectively are installed on the bottom face of the head part 20.

The passage in which the coating circulates and the passage in which air circulates are connected to the coating supply part. This coating supply part is provided with a coating valve that, by air pressure, opens and shuts the passage in which coating circulates.

The air motor is connected to the passage in which air circulates, and the rotary atomization head 21 can be rotated at high speed by supplying air to this air motor. This air motor is further connected to the optical fiber that transmits an optical signal. The revolutions of the air motor are output as an optical signal through this optical fiber. The air cap 22 is connected to the passage in which air circulates. The flow rate of air ejected from the air cap 22 changes by changing the flow rate of air supplied to this air cap 22, so that the coating range is adjusted.

On the bottom face of head part 20, the cascade insertion part 24 as the insertion part in which the top side of the cascade 41 is inserted and a locating pin insertion hole 203 in which the locating pin 436 is inserted are formed. The connecting terminal 25 of the electric power transmission line 26 is provided on the bottom face of the cascade insertion part 24 and electrically connected to the rotary atomization head 21. The electric power output from the cascade is transmitted to the rotary atomization head 21 through this electric power transmission line 26.

Hereinafter, operation of the coating apparatus 1 will be explained. First, air is supplied from the air supply source to the air motor to rotate the rotary atomization head 21 at high speed. In addition, current from the low voltage power supply is boosted by the cascade 41 to apply high voltage current to the rotary atomization head 21.

Then, air is supplied to the coating supply part to open the coating valve. The coating is discharged from this coating supply part to the inner circular face of the rotary atomization head 21, applied with high voltage to be charged, atomized by the centrifugal force of the rotary atomization head 21, and then sprayed from the rotary atomization head 21 toward a workpiece. Electrostatic coating is conducted in this way.

Figure 5:
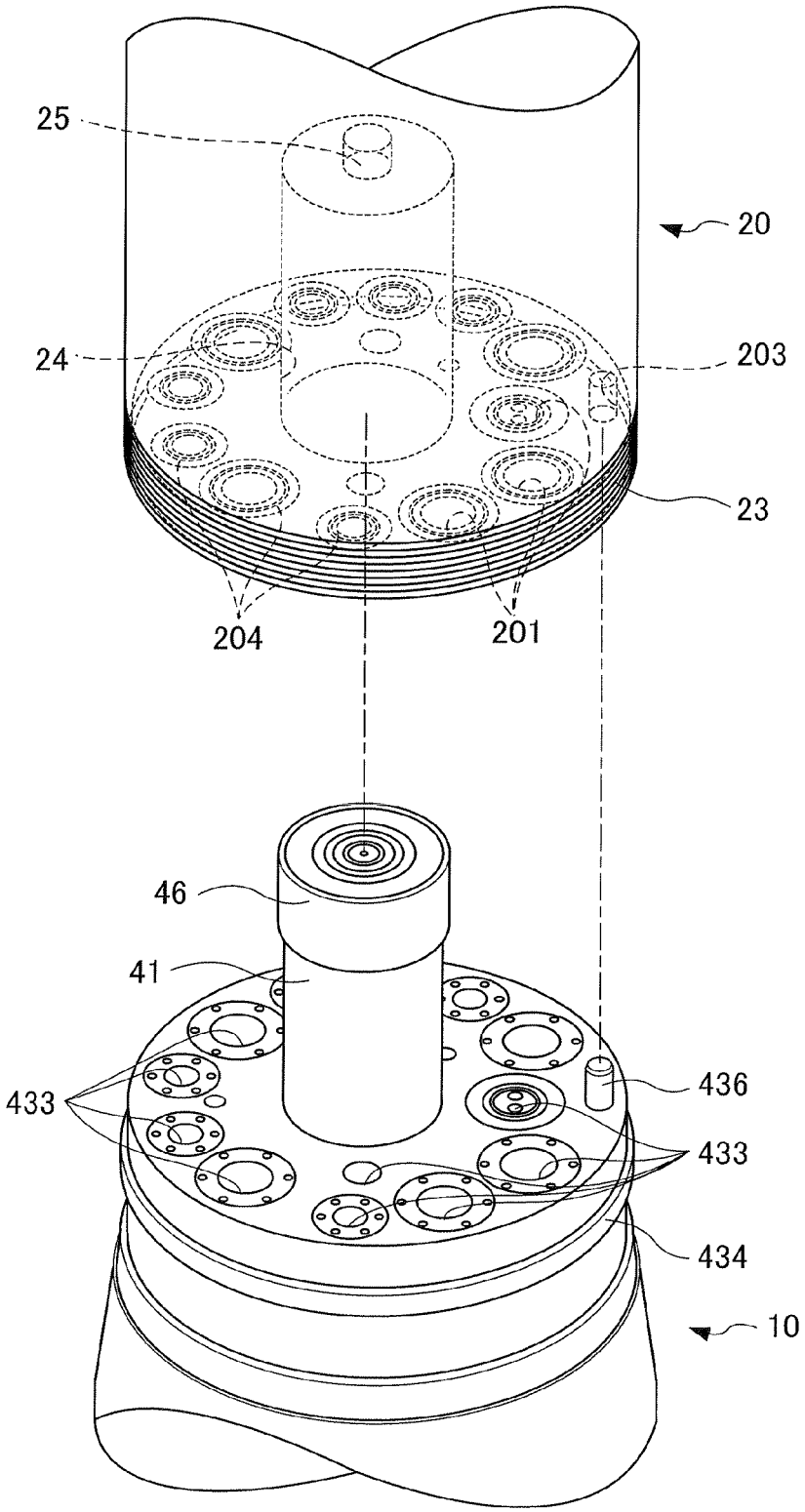
FIG. 5 is a perspective view that describes the procedure for connecting the body part and the head part of the coating apparatus according to the first embodiment of the present invention.

Hereinafter, the procedure for connecting the body part 10 with the head part 20 of the coating apparatus 1 is explained in reference to FIG. 5. First, the body part 10 and the head part 20 approach each other, and then the locating pin 436 is inserted in the locating pin insertion hole 203 while the projected part of the cascade 41 is inserted in the cascade insertion part 24. This leads to determine the relative position of the body part 10 and the head part 20.

Then, by rotating connection ring 50 the threaded part 52 of the connection ring 50 is threadably mounted on the threaded part 23 of the head part 20. Then, the bottom face of head part 20 abuts the top face of body part 10, whereby the third ports 433 are connected to the fourth ports 201. At this point, the O rings 204 installed on the bottom side of head part 20 are firmly attached to the top face of body part 10, whereby the airtightness between the third ports 433 and the fourth ports 201 is maintained. Meanwhile, the top face of the cascade 41 inserted in the cascade insertion part 24 is connected to the connecting terminal 25 of the cascade insertion part 24.

The present embodiment provides the following effects. (1) The body part 10 and the head part 20 approach each other to be fixed by the connection ring 50. Then, the projected part of the cascade 41 is inserted in the cascade insertion part 24 to connect the cascade 41 with the connecting terminal 25 of the electric power transmission line, and then the third ports 433 are connected to the fourth ports 201. Thus, the electric power output from cascade 41 can be transmitted through the electric power transmission line. In addition, an optical signal, air, and coating that circulate in the tubes 13 and the passage 435 can be circulated in the passage 202, and those that circulate in passage 202 can be circulated in the tubes 13 and the passage 435. Since the coating apparatus 1 is thus divided into the body part 10 and the head part 20, the coating apparatus 1 can be easily repaired and adjusted. Even if the coating apparatus 1 is installed on a robot arm3, it is not necessary to detach the entire coating apparatus 1 from the robot arm 3, so that it is possible to detach only the head part 20, when the coating apparatus 1 is repaired and adjusted.

(2) The O rings 204 is installed on the bottom face of the head part 20, so that the installation condition of the O rings 204 can be easily checked, and the airtightness between the third ports 433 and the fourth ports 201 can be maintained.

Second Embodiment

Figure 6:
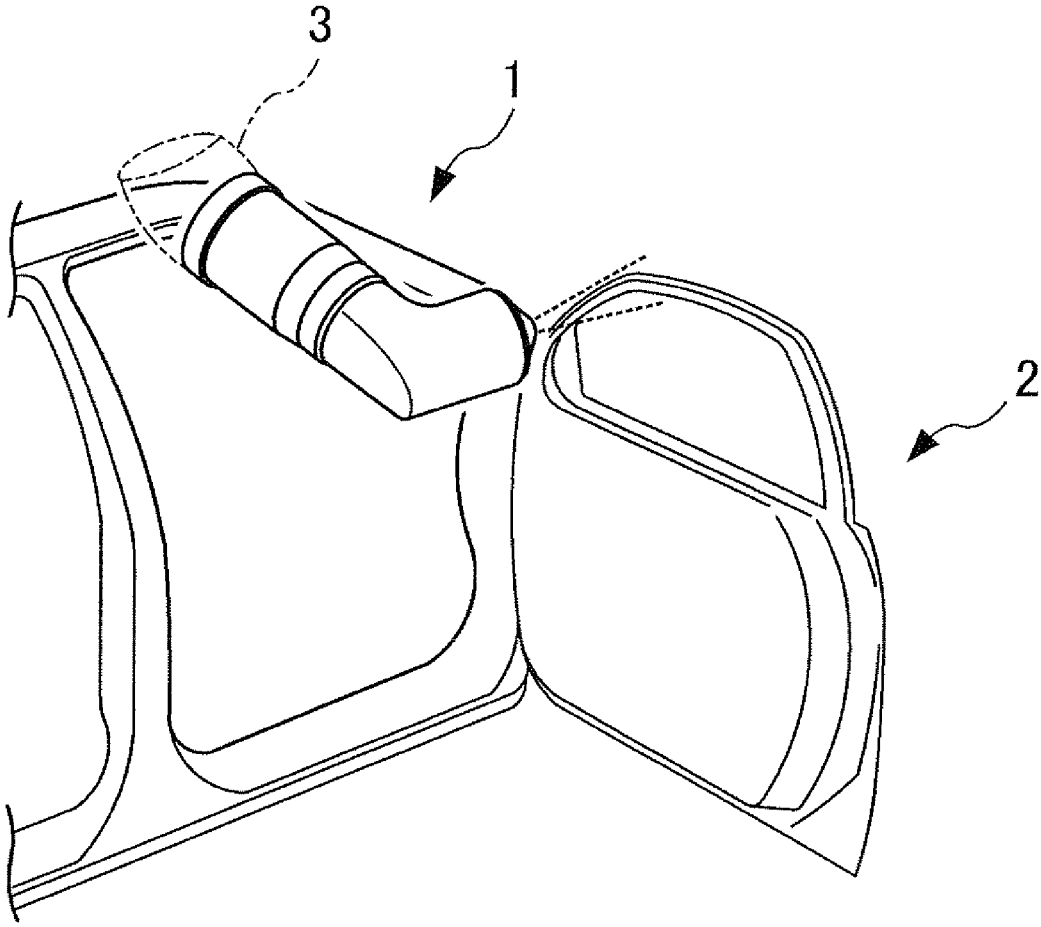
FIG. 6 is a perspective view that shows operation of the coating apparatus according to a second embodiment of the present invention.
Figure 7:
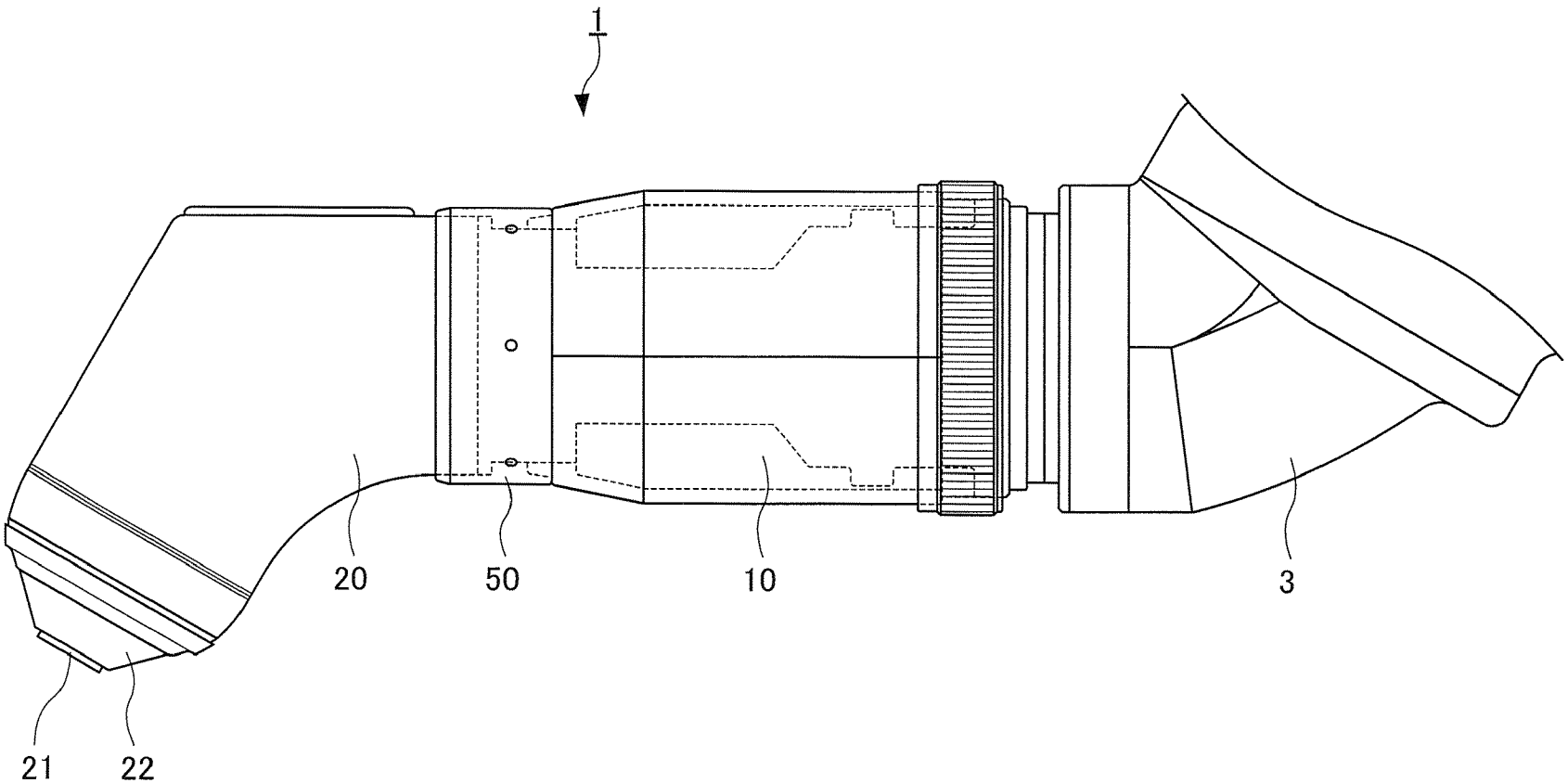
FIG. 7 is a side view of the coating apparatus according to the second embodiment of the present invention.

FIG. 6 is a perspective view that shows operation of the coating apparatus 1 according to a second embodiment of the present invention. FIG. 7 is a side view of the coating apparatus 1. The coating apparatus 1 conducts electrostatic coating for a vehicle's body 2, and comprises a body part 10 as a columnar body installed on the top of a robot arm 3, a head part 20 as a body detachably installed on the top of this body part 10, and a connection ring 50 connecting the body part 10 with the head part 20.

Figure 8:
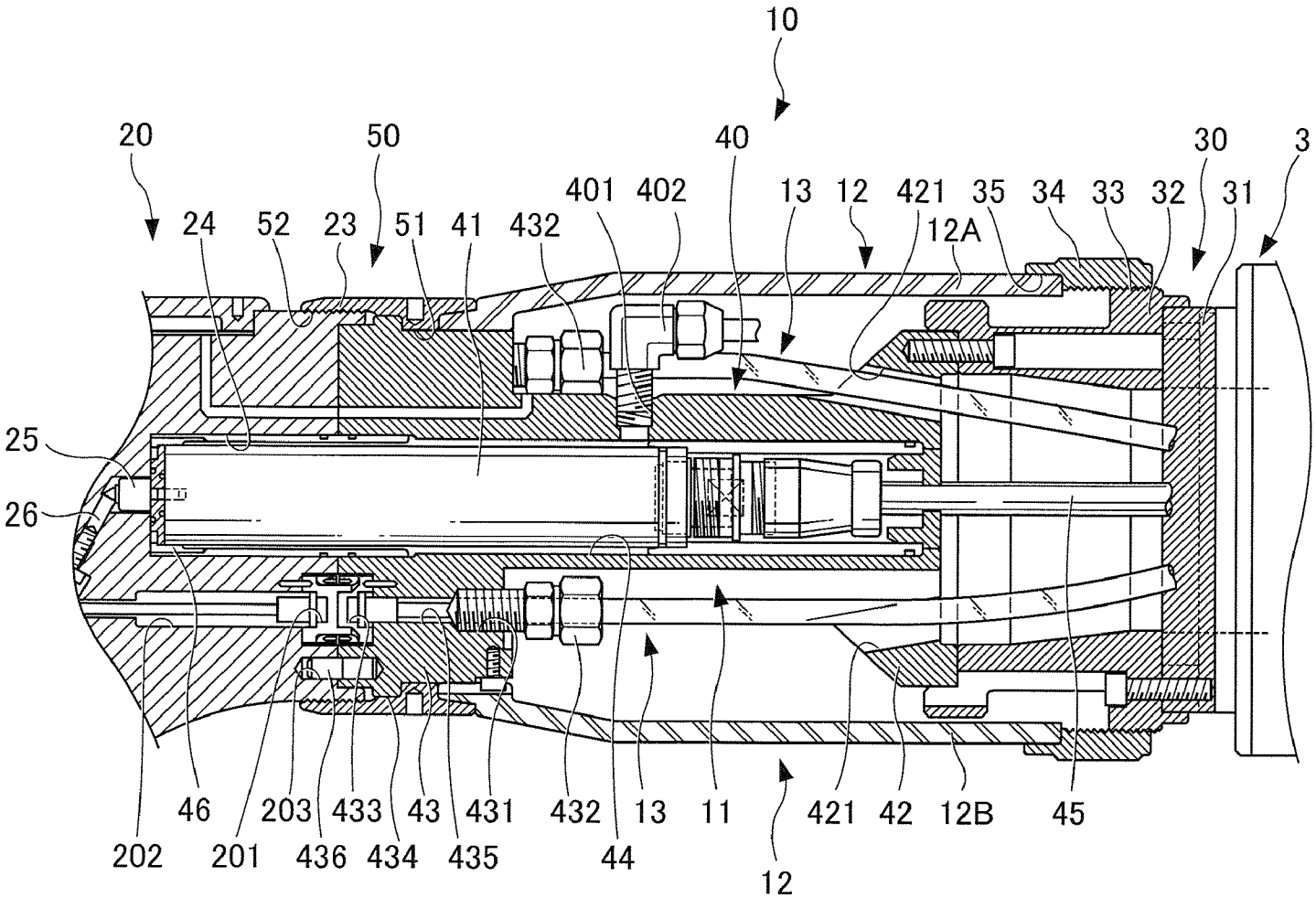
FIG. 8 is a part enlarged section view of the coating apparatus according to the second embodiment of the present invention.

FIG. 8 is a part enlarged section view of the coating apparatus 1. The body part 10 is provided with a long main part 11 of the body part to which the tube 13 as the plurality of channels is connected, and a cover part 12 that covers the peripheral face of the central part of this main body part 11 of the body part.

The main part 11 of the body part is provided with a base part 30, a cascade accommodation part 40 installed in this base part 30 and accommodating the cascade 41.

The base part 30 is provided with a discoid bottom part 31, and a wall part 32 arranged on the outer periphery of this bottom part 31. A threaded part 33 is provided on the outer peripheral face of the wall part 32, and a cylindrical holder 34 is threadably mounted on this threaded part 33. A concave part 35 is formed over the periphery thereof inside the top side of this holder 34.

The cascade accommodation part 40 is in long shape, and a bottom flange part 42 and a top flange part 43, in the shape of guard, are formed on the bottom side and the top side thereof. As a result, the outer diameter of the central part of the body part 10 is smaller than that of the bottom side and the top side thereof.

A through-hole 44 is formed, stretching from the bottom side to the top face of the cascade accommodation part 40, and accommodates the cascade 41. Specifically, the cascade 41 is accommodated, so that a space exists between most of the outer peripheral face of cascade 41 and the inner peripheral wall face of the through-hole 44.

The cascade 41 is connected to a low voltage cable 45 passing through the base part 30 and then extends, and electric power supplied through this low voltage cable 45 is boosted and output. The top side of this cascade 41 axially projects from the approximate center of the top face of the top flange part 43, and a cascade cover 46 is installed on the top of this cascade 41.

A first port 401 is provided on the outer peripheral face of the cascade accommodation part 40, and this first port 401 is connected to one of the above-mentioned tubes 13 through one of the joints 402.

The bottom flange part 42 is fixed to the base part 30, sealing the open face of the base part 30. A plurality of tube insertion holes 421 through which the above-mentioned tubes 13 are inserted are formed in this bottom flange part 42.

A plurality of second ports 431 are provided, being circularly arranged on the bottom face of top flange part 43. These second ports 431 are connected to the above-mentioned tubes 13 through the joints 432 respectively. In addition, a protrusion 434 is formed over the outer peripheral face of the top flange part 43.

The third ports 433 are provided on the top face of top flange part 43, being circularly arranged. These third ports 433 are provided, being evenly exposed to the top face of top flange part 43, and communicated with the second ports 431 and the first port 401 respectively through the passage 435 as a channel. The second port 431 shown in FIG. 8 is communicated with the through-hole 44 that accommodates the cascade 41, and other second ports (not shown) are communicated with the third ports 433. In addition, a locating pin 436 is provided, projecting on the outer side of the top face of the top flange part 43.

The connection ring 50 is in a cylindrical shape, and a protrusion 51 is formed over the inner peripheral face along the bottom side of the connection ring 50. In addition, a threaded part 52 is formed on the inner peripheral face along the top side of the connection ring 50. The protrusion 51 of the connection ring 50 is latched to the protrusion 434 of the top flange part 43, whereby the connection ring 50 is restricted to move to a top side, but it is allowed to be rotatable.

A plurality of tubes 13 are transparent and pass through the flange face of the robot arm 3 from a light supply source (not shown), a compressed air supply source (not shown), and a coating supply source (not shown), and then extend to the inside of the base part 30. In addition, these tubes 13 are inserted through to tube insertion holes 421 in the cascade accommodation part 40, extends along the outer peripheral face in the cascade accommodation part 40, and are then connected to the second ports 431 and the first port 401.

An optical signal supplied from the light supply source, air supplied from the compressed air supply source, and liquid coating supplied from the coating supply source circulate in these tubes 13 and reach the second ports 431 and then the fourth ports 201 through the passage 435. In addition, the tube 13 extending from the light supply source accommodates an optical fiber, and an optical signal is transmitted through this optical fiber.

The cover part 12 is in a cylindrical shape and is allowed to be divided into two parts along the main part 11 of the body part. Specifically, the cover part 12 is consisting of two half-cylindrical cover pieces 12A and 12B. The top edges of the cover pieces 12A and 12B are inserted and sandwiched between the inner peripheral face of the connection ring 50 and the outer peripheral face of the top flange part 43 in the main part 11 of the body part, and it is maintained by this connection ring 50. Moreover, the bottom edge of the cover pieces 12A and 12B engages with a concave part 35 on the top side of the holder 34 of the main part 11 of the body part, and it is maintained by this holder 34.

The head part 20 is in an approximate dog-leg shape, in which the top end thereof bends, and is provided with an air motor (not shown), the rotary atomization head 21 rotationally driven by this air motor, a coating supply part (not shown) that supplies coating to the rotary atomization head 21, and an air cap 22 surrounding the rotary atomization head 21 (See FIG. 7). The threaded part 23 is formed on the outer peripheral face along the bottom side of the head part 20, and the threaded part 52 of the connection ring 50 is threadably mounted on the threaded part 23 of this head part 20.

On the bottom face of the head part 20, the fourth ports 201 are arranged respectively at the position corresponding to the third ports 433 provided in the top flange part 43 in the body part 10. These fourth ports 201 are provided, being evenly exposed to the bottom base of the head part 43, and communicated with the above-mentioned coating supply part, the air motor, the rotation atomization head, and the air cap 22 through the passage 202 as a channel.

Accordingly, an optical signal, air, and liquid coating that have reached to the fourth ports 201 circulate in this passage 202, and are then supplied to the coating supply part, the air motor, the rotary atomization head 21, and the air cap 22. In addition, an optical signal, air, and liquid coating output from the coating supply part, the air motor, the rotary atomization head 21 and then circulating in the passage 202 reaches the fourth ports 201 and then circulate to the passage 435 and the tubes 13.

In addition, a plurality of O rings 204 surrounding the fourth ports 201 respectively are installed on the bottom face of the head part 20.

The coating supply part is connected to the passage in which the coating circulates and that in which air circulates. This coating supply part is provided with a coating valve that, by air pressure, opens and shuts the passage in which coating circulates.

The air motor is connected to the passage in which air circulates, and the rotary atomization head 21 can be rotated at high speed by supplying air to this air motor. This air motor is further connected to the optical fiber that transmits an optical signal. The revolutions of the air motor are output as an optical signal through this optical fiber. The air cap 22 is connected to the passage in which air circulates. The flow rate of air ejected from the air cap 22 changes by changing the flow rate of air supplied to this air cap 22, so that the coating range is adjusted.

The cascade insertion part 24 in which the top side of the cascade 41 is inserted and a locating pin insertion hole 203 in which the locating pin 436 is inserted are formed on the bottom face of head part 20. The connecting terminal 25 of the electric power transmission line 26 is provided on the bottom face of the cascade insertion part 24 and electrically connected to the rotary atomization head 21. The electric power output from the cascade is transmitted to the rotary atomization head 21 through this electric power transmission line 26.

Hereinafter, operation of the coating apparatus 1 will be explained. First, air is supplied from the air supply source to the air motor to rotate the rotary atomization head 21 at high speed. In addition, current from the low voltage power supply is boosted by the cascade 41 to apply high voltage current to the rotary atomization head 21.

Then, air is supplied to the coating supply part to open the coating valve. The coating is discharged from this coating supply part to the inner circular face of the rotary atomization head 21, applied with high voltage to be charged, atomized by the centrifugal force of the rotary atomization head 21, and then sprayed from the rotary atomization head 21 toward a workpiece. Electrostatic coating is conducted in this way.

Figure 9:
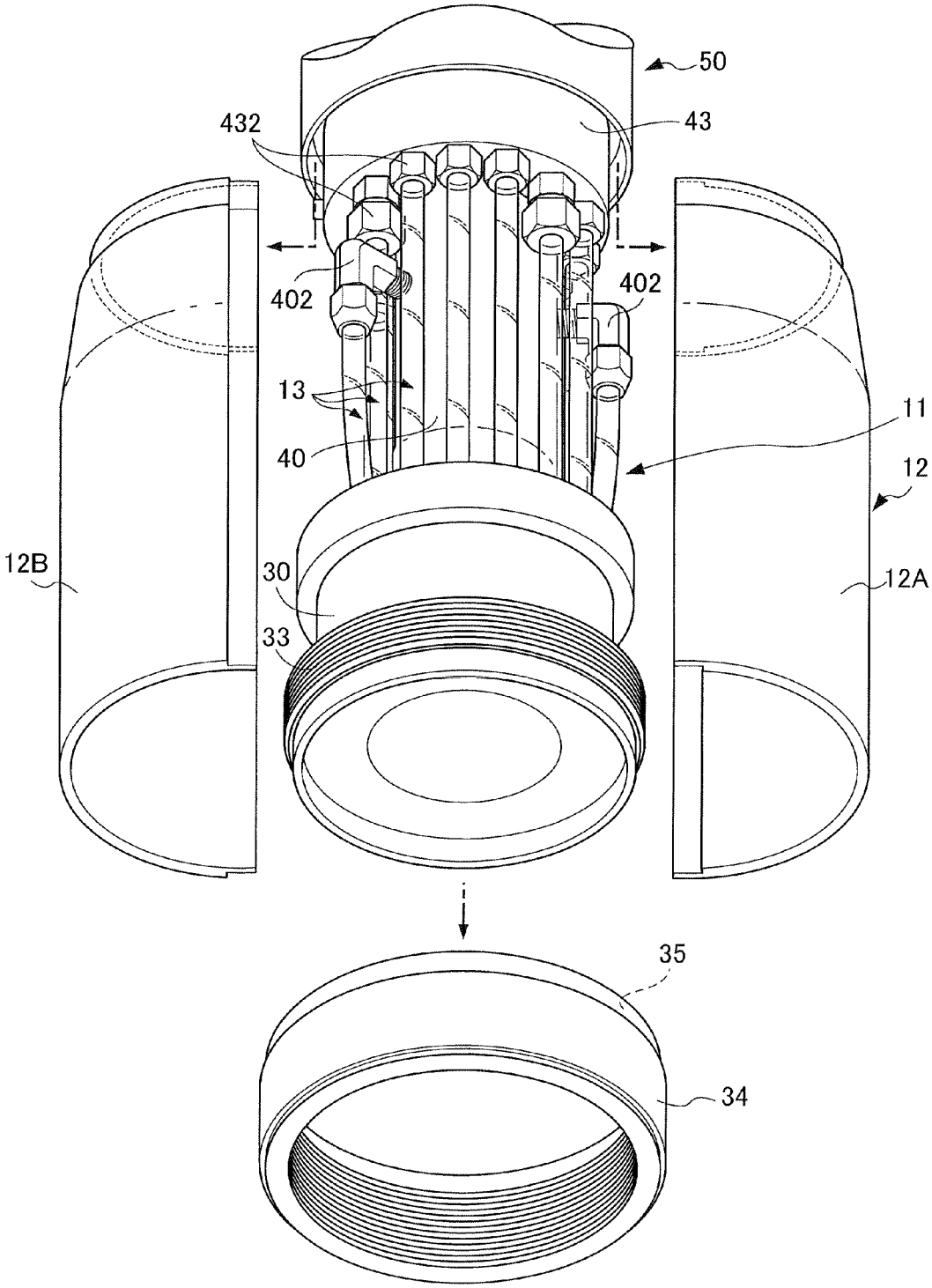
FIG. 9 is a perspective view that describes the procedure for detaching the cover part of the coating apparatus according to the second embodiment of the present invention.

Hereinafter, the procedure for detaching the cover part 12 from the coating apparatus 1 is explained in reference to FIG. 9. First, the holder 34 is rotated to be retreated, whereby retention of the bottom edge of the cover part 12 by the holder 34 is released. Next, after the cover part 12 is moved to the bottom side of the coating apparatus 1, the top edge of cover part 12 is extracted from between the connection ring 50 and the top flange part 43, whereby retention of the top edge of the cover part 12 by this connection ring 50 is released. Then, the cover part 12 is divided into the cover pieces 12A and 12B. The cover part 12 is detached in this way.

The present embodiment provides the following effects. (3) Since the outer diameter of the central part of the main body 11 of the body part is smaller than that of the both end sides thereof, the coating apparatus can be lightened. In addition, at least parts of the plurality of channels are transparent tubes 13, and the tubes 13 are arranged on the outer peripheral face along the central part of the main body. Thus, air and coating channels can be easily checked without detaching the coating apparatus from the robot arm 3 by visually checking the situation in the tubes 13 and installing the measuring instrument to these tubes. For example, in the case in which a problem occurs when the coating color of a vehicle is changed, the flow condition of coating can be easily checked by visually checking the tube 13 in which this coating circulates. Moreover, in the case in which a problem regarding coating range control occurs, the flow condition of air can be easily checked by exchanging the tube in which air circulates for the tube 13 to which a pressure instrument and a flow instrument is installed.

(4) The cover part 12 that covers the central part of the main body 11 of the body part is provided, whereby contamination of the tube 13 can be prevented while the coating apparatus is driven. On the other hand, when the coating apparatus 1 is checked, the tube 13 can be easily checked by detaching only the cover part 12.

Third Embodiment

Figure 10:
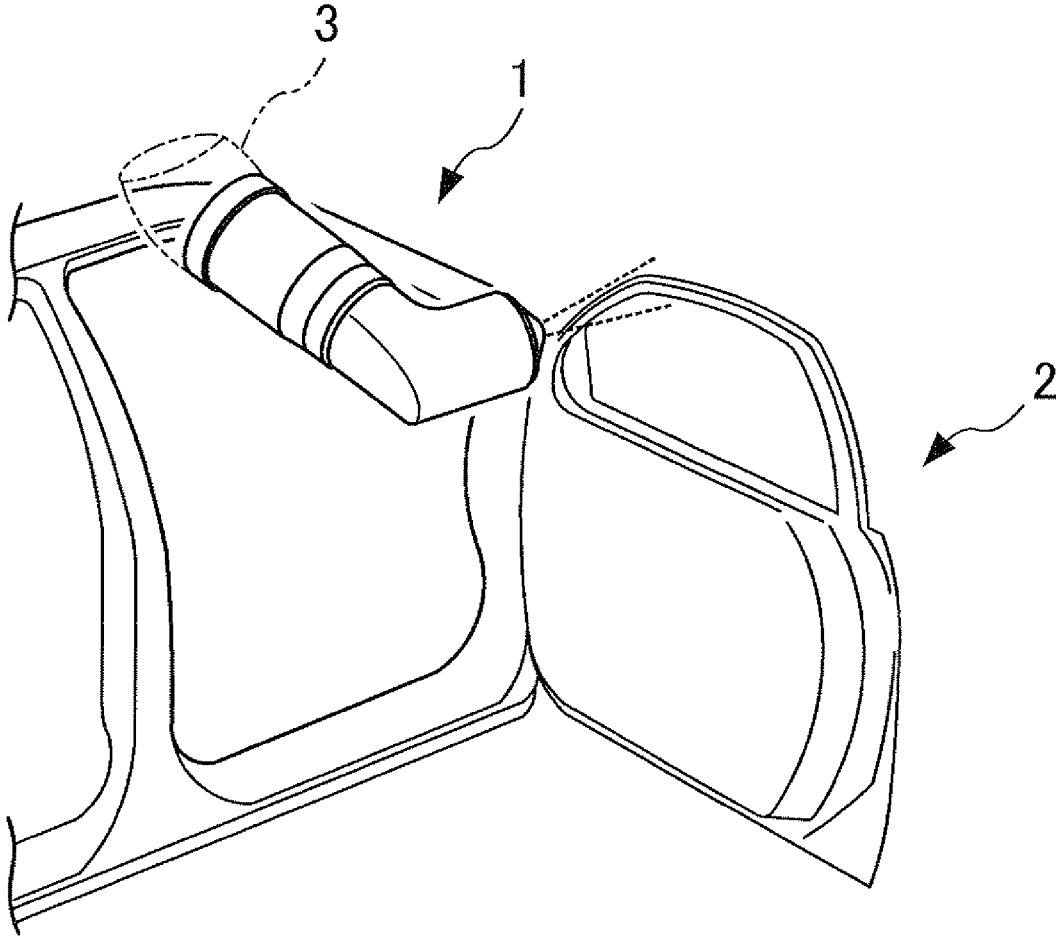
FIG. 10 is a perspective view that shows a schematic structure of the coating apparatus according to the third embodiment of the present invention.
Figure 11:
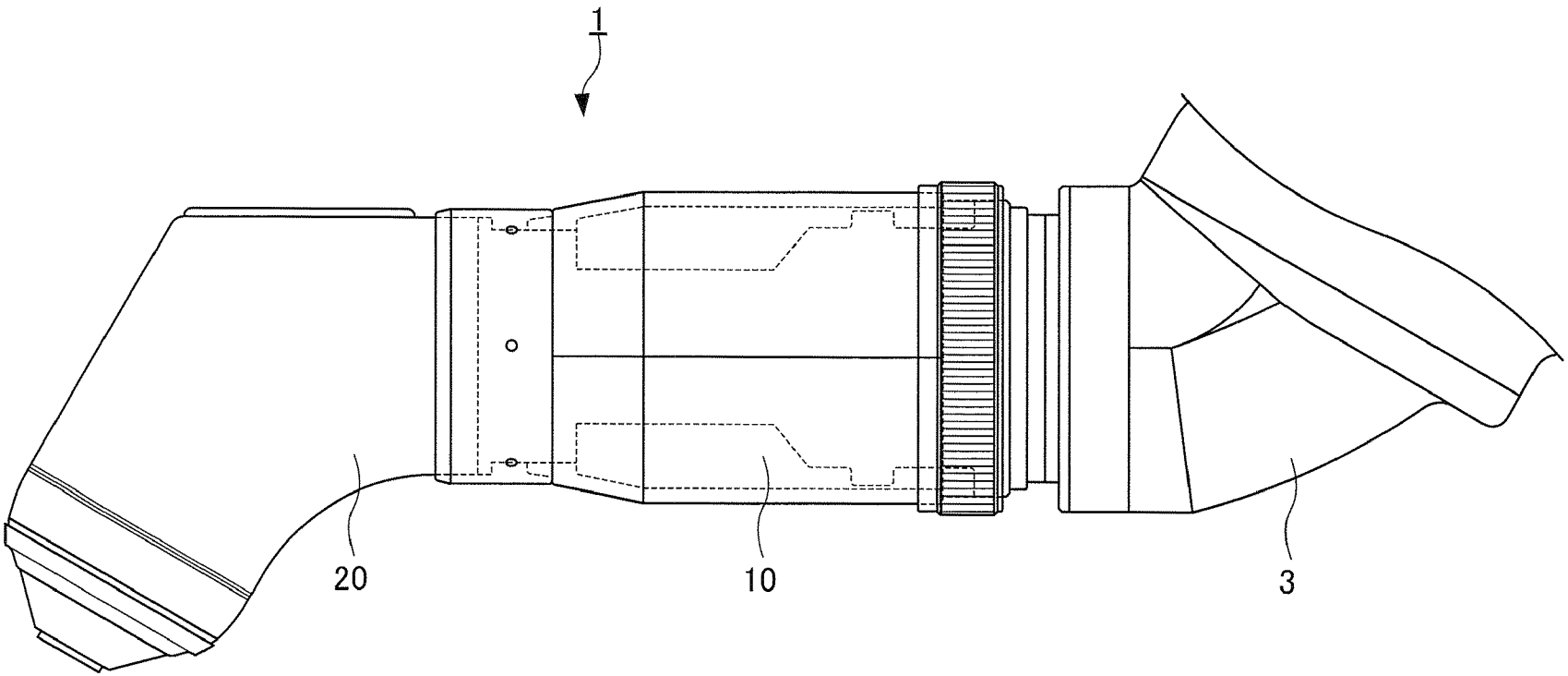
FIG. 11 is a side view of the coating apparatus according to the third embodiment of the present invention.

FIG. 10 is a perspective view that shows a schematic structure of the coating apparatus 1 according to one embodiment of the present invention. FIG. 11 is a side view of the coating apparatus 1. The coating apparatus 1 conducts electrostatic coating for a vehicle's body 2, and comprises a columnar body 10 installed on the top of a robot arm 3 and a head part 20 in an approximate dog-leg shape and detachably installed on the top of this body part 10.

Figure 12:
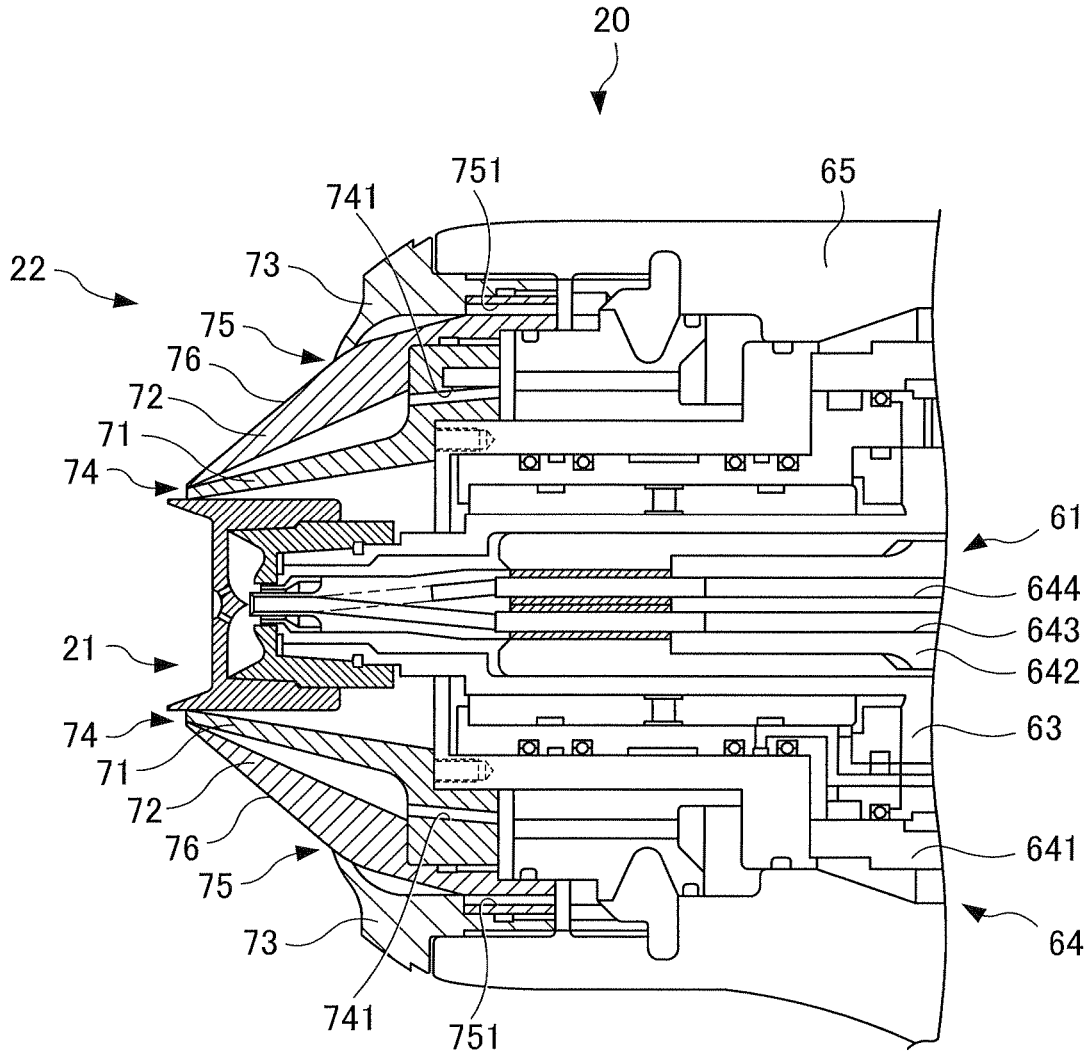
FIG. 12 is a sectional view of the top part of the coating apparatus according to the third embodiment of the present invention.

FIG. 12 is a sectional view of the top part of the head part 20. The head part 20 is provided with an air motor 61, the rotary atomization head 21 rotationally driven by this air motor 61, the coating supply part (not shown ) that supplies coating to the rotary atomization head 21, an air cap 22 surrounding the rotary atomization head 21, and a housing 65 that accommodates these components.

The air motor 61 is provided with a cylindrical pivot 63, a motor housing 64 that maintains this shaft 63 rotatably, wherein the shaft 63 is rotated at high speed by air supplied from the air supply source (not shown).

The coating supply part is connected to the passage in which the coating circulates and that in which air circulates. This coating supply part is provided with a coating valve that, by air pressure, opens and shuts the passage in which coating circulates. The coating valve is opened and shut by changing the pressure of air supplied to this coating supply part to adjust the amount of coating to be supplied to the rotary atomization head 21.

The motor housing 64 is provided with a housing main part 641 surrounding the outer peripheral face of the pivot 63 and an insertion part 642 fixed to this housing main part 641 and inserted through the inside of the pivot 63. That is, the shaft 63 is held rotatably between the housing main part 641 and the insertion part 642 of the motor housing 64.

The insertion part 642 is provided with a coating supply channel 643 in which coating supplied from the above-mentioned coating supply part circulates and cleaning solution supply channel 644 in which a cleaning solution circulates. The coating supply channel 643 and the cleaning solution supply channel 644 reaches the top of insertion part 642.

The rotary atomization head 21 has an approximate conic shape in which the inner diameter increases toward the top side thereof, and it is installed on the top of the pivot 63.

The air cap 22 is installed on the housing 65. This air cap 22 is provided with an internal air cap 71 surrounding the rotary atomization head 21, a shaping air cap 72 surrounding the internal air cap 71, and an assist air cap 73 surrounding the shaping air cap 72.

The internal air cap 71 is in an approximate cylindrical shape in which the outer diameter decreases toward the top side thereof, and the top of this internal air cap 71 is located adjacent to the top of the rotary atomization head 21.

The shaping air cap 72 is in an approximate cylindrical shape in which the outer diameter decreases toward the top side thereof, and the top of this shaping air cap 72 is located adjacent to the top of the rotary atomization head 21. A space between the shaping air cap 72 and the internal air cap 71 is the first circular air nozzle 74 surrounding the rotary atomization head 21. This first air nozzle 74 is located adjacent to the rotary atomization head 21.

A plurality of the first air passages 741 communicated with the first air nozzle 74 is formed in the internal air cap 71. These first air passages 741 are provided with air from the air supply source (not shown).

When air is supplied from the air supply source to the first air passages 741, this supplied air is ejected from the first air nozzle 74 toward the top edge of the rotary atomization head 21 to be shaping air.

Assist air cap 73 surrounds the bottom side of the shaping air cap 72, and the top of this assist air cap 73 is located on the bottom side of the shaping air cap 72. A space between assist air cap 73 and shaping air cap 72 is the second circular air nozzle 75 surrounding the first air nozzle 74. Thus, the second air nozzle 75 is located at the rear side from the first air nozzle 74 to the coating spray direction. The outer peripheral face of the shaping air cap 72 is the slope 76 stretching from the second air nozzle 75 to the first air nozzle 74.

A plurality of second air passages 751 communicated with the second air nozzle 75 is formed in the shaping air cap 72. These second air passages 751 are provided with air supplied from the air supply source (not shown).

When air is supplied from the air supply source to the second air passages 751, this supplied air is ejected from the second air nozzle 75 along the slope 76 to be assist air.

Hereinafter, operation of the above-mentioned coating apparatus 1 will be explained. First, air is supplied from the air supply source to the air motor 61 to rotate the rotary atomization head 21 at high speed. In addition, current (not shown) from the low voltage power supply is boosted to apply high voltage current to the rotary atomization head 21.

Then, air is supplied to the coating supply part to open the coating valve is opened, and thereby supplying coating from this coating supply part to the coating supply channel 643. Accordingly, coating is discharged from the coating supply channel 643 to the inner circular face of the rotary atomization head 21, applied with high voltage to be charged, atomized by the centrifugal force of the rotary atomization head 21, and then sprayed from the rotary atomization head 21 to a workpiece. Electrostatic coating is conducted in this way.

At this point, while shaping air is ejected from the first air nozzle 74, assist air is ejected from the second air nozzle 75. By adjusting the ejection amount of shaping air and assist air properly, the pattern diameter of the coating pattern is adjusted.

Figure 13:
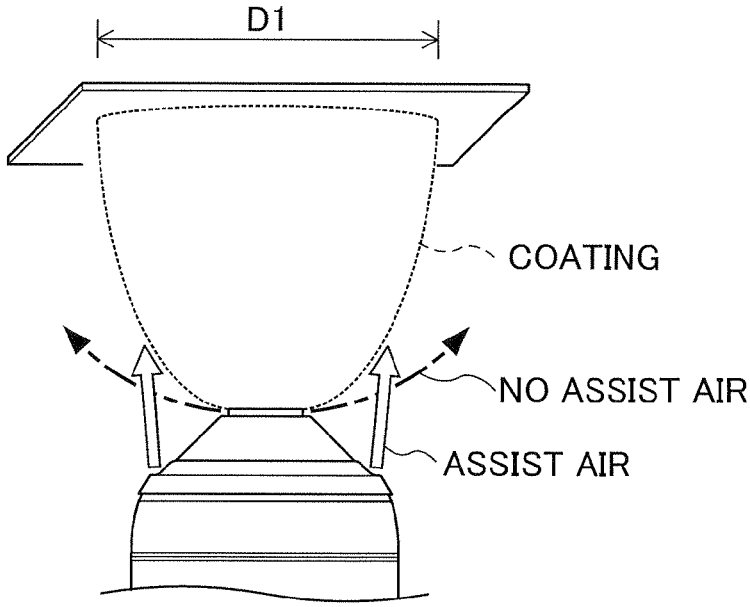
FIG. 13 is a diagram that shows the state in which assist air is ejected by the coating apparatus according to the third embodiment of the present invention.

For example, when assist air is ejected from the second air nozzle 75, it narrows the pattern diameter of coating to be sprayed as shown in FIG. 13. Accordingly, the pattern diameter of the coating decreases to D1.

Figure 14:
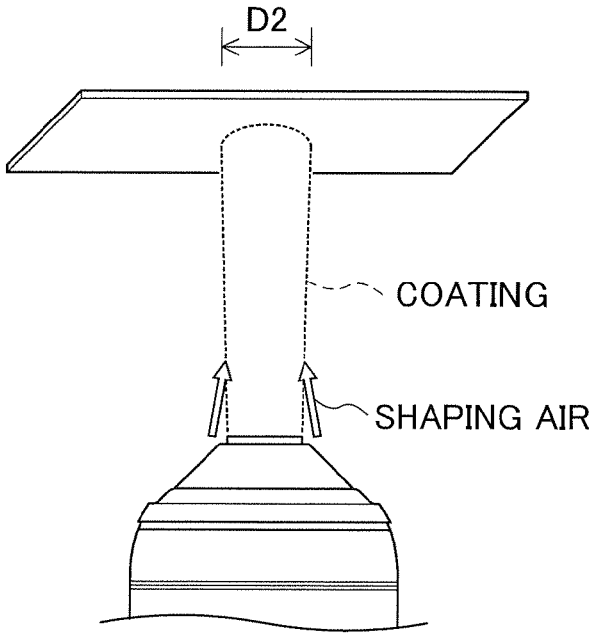
FIG. 14 is a diagram that shows the state in which shaping air is ejected by the coating apparatus according to the third embodiment of the present invention.

On the other hand, when shaping air is ejected from the first air nozzle 74, assist air further narrows the pattern diameter of coating to be sprayed as shown in FIG. 14. Accordingly, the pattern diameter of the coating decreases to D2 which is smaller than D1.

Figure 15:
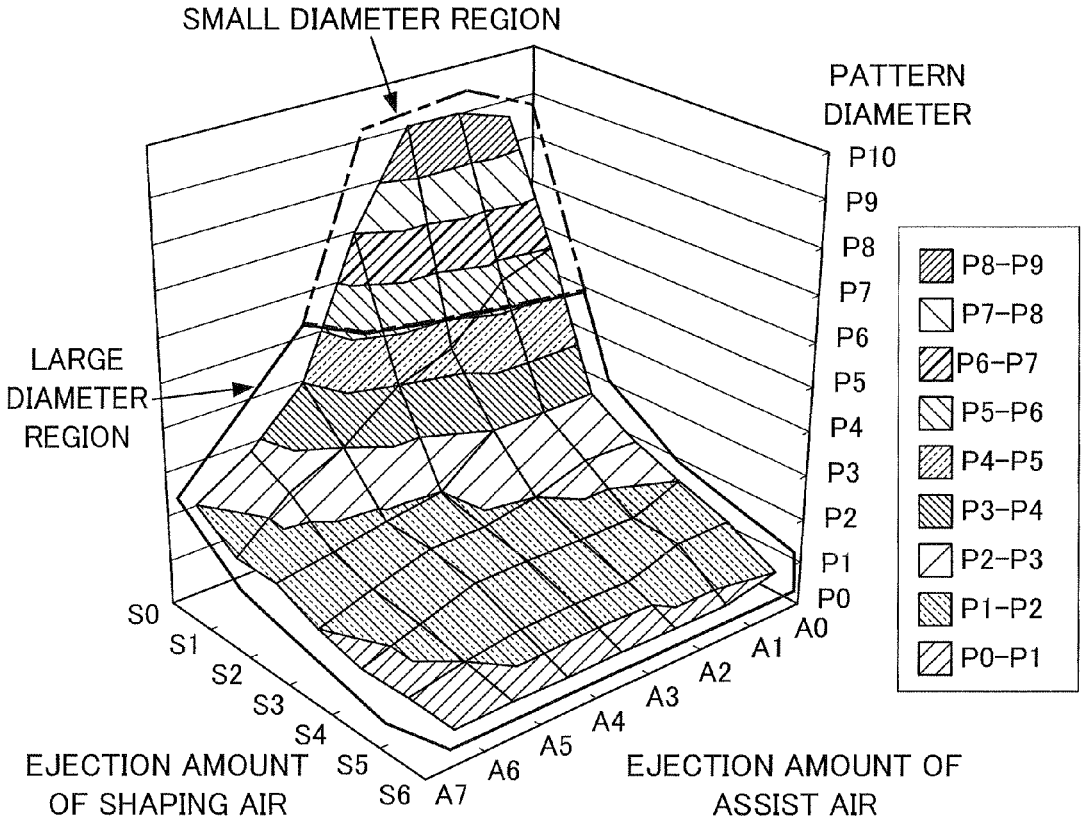
FIG. 15 is a diagram for showing a relationship among the ejection amount of shaping air, that of assist air, and the coating pattern diameter according the third embodiment of the present invention.

Hereinafter, the combination of the ejection amount of shaping air and assist air is explained. FIG. 15 is a diagram for showing a relationship among the ejection amount of shaping air, that of assist air, and the coating pattern diameter. In FIG. 15, the ejection amount of shaping air increases as it changes from S0 to S6, the ejection amount of the assist air increases as it changes from A0 to A7, and the coating pattern diameter increases as it changes from P0 to P10.

When the ejection amount of shaping air and assist air decreases, the pattern diameter increases. On the other hand, when the ejection amount of shaping air and assist air increases, the pattern diameter decreases.

Moreover, when the ejection amount of shaping air is small, the influence of the ejection amount of assist air high that the pattern diameter significantly changes in accordance with the ejection amount of assist air. On the other hand, when the ejection amount of shaping air is large, the influence of the ejection amount of assist air is low, and the pattern diameter does not changes too much even if the ejection amount of the assist air is changed.

In FIG. 15, the area surrounded by solid line is a large diameter area of the coating pattern. By decreasing the coating speed of the coating apparatus and increasing the ejection amount of coating, the coating pattern diameter can be increased. Therefore, the cycle time can be shortened, and the cost can be decreased by reducing the number of coating apparatuses. On the other hand, the area surrounded by dashed-dotted line is a small diameter area of the coating pattern. The film thickness of the coated part can be ensured, and additionally, the waste of materials due to overspraying can be reduced. Therefore, the running cost can be decreased.

The present embodiment provides the following effects. (5) The first circular air nozzle 74 is provided, surrounding the rotary atomization head 21, and the second air nozzle 75 is further provided, surrounding the first air nozzle 74. In addition, the slope 76 is provided, stretching from the second air nozzle 75 to the first air nozzle 74. Thus, air is ejected forward from the second air nozzle 75 along the slope 76 to generate an air curtain, so that an air ejection direction can be stable, whereby the coating pattern can be easily set. In addition, whirlpools can be prevented from generating in the flow of air, and thereby causing no returning whirlpools of coating, so that the contaminated nozzle part can be prevented.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims. While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A coating apparatus that conducts electrostatic coating by supplying liquid coating to a rotary atomization head as the rotary atomization head is rotated, applying a high voltage thereto and thereby charging and atomizing liquid coating liquid coating and then spraying the liquid coating from the rotary atomization head, comprising;

a body part;

a head part detachably installed to the body part;

a connection part connecting the body part with the head part, wherein the body part is provided with a cascade that boosts and outputs electric power and a plurality of first channels in which at least one of an optical signal representing the revolutions of the rotary atomization head, air, and coating circulates, the head part is provided with the rotary atomization head, an electric power transmission line that transmits electric power output from the cascade, and a second channel, on a connecting face of the body part, at least part of the cascade projects, and an end face of the first channel is exposed, and on a connecting face of the head part, the electric power transmission line is connected, and an insertion part in which a projected part of the cascade is inserted is formed, and an end face of the second channel connected to the end face of the first channel is exposed.

2. A coating apparatus that conducts electrostatic coating by supplying liquid coating to a rotary atomization head as the rotary atomization head is rotated, applying a high voltage thereto and thereby charging and atomizing liquid coating liquid coating and then spraying the liquid coating from the rotary atomization head, comprising;

a main part;

the rotary atomization head installed on a top side of the main part, and a plurality of channels extending from a bottom side to the top side of the main part, in the plurality of channels, air and coating circulating, wherein an outer diameter of a central part of the main part body is smaller than that of the both end sides thereof, at least parts of the plurality of channels are transparent tubes, and the tubes are arranged on an outer peripheral face of the central part of the main part.

3. The coating apparatus according to claim 2 further comprising a cover part that covers the central part of the main part.

4. A coating apparatus that conducts electrostatic coating by supplying liquid coating to a rotary atomization head as the rotary atomization head is rotated, applying a high voltage thereto and thereby charging and atomizing liquid coating liquid coating and then spraying the liquid coating from the rotary atomization head, comprising;

a first continuous circular air nozzle being formed, surrounding the rotary atomization head;

a second continuous circular air nozzle being formed, surrounding the first air nozzle, the second air nozzle located at a rear side from the first air nozzle to a coating spray direction, and a slope stretching from the second air nozzle to the first air nozzle, wherein a coating pattern of atomized liquid coating liquid is adjusted in accordance with a combination of amounts of air ejected from the first air nozzle and ejected from the second air nozzle.

* * * * *